United States Patent [19]

Kückens et al.

[11] Patent Number: 4,589,326

[45] Date of Patent: May 20, 1986

[54] SELF-LOADING PISTOL IN THE FORM OF A MECHANICALLY LOCKED RECOIL LOADER

[75] Inventors: Alexander Kückens, Gross Sarau; Willi Korth, Ratzeburg, both of Fed. Rep. of Germany

[73] Assignee: Technica Entwicklungsgesellschaft mbH & Co. KG, Ratzeburg, Fed. Rep. of Germany

[21] Appl. No.: 440,228

[22] PCT Filed: Mar. 11, 1982

[86] PCT No.: PCT/DE82/00052

§ 371 Date: Oct. 28, 1982

§ 102(e) Date: Oct. 28, 1982

[51] Int. Cl.[4] ..... F41C 5/00

[52] U.S. Cl. ..... 89/145; 89/147

[58] Field of Search ..... 89/144, 145, 146, 147; 42/65, 69 B, 70 F, 65 B

[56] References Cited

U.S. PATENT DOCUMENTS

| | | | |
|---|---|---|---|
| 16,411 | 1/1857 | Tonks | 42/65 |
| 630,478 | 8/1899 | Behr | 42/65 |
| 2,177,227 | 10/1939 | Seidel | 89/145 |
| 2,464,427 | 3/1949 | Wilson | 89/147 |
| 3,060,810 | 10/1962 | Hillberg | 89/145 |
| 3,069,976 | 12/1962 | Stevens | 89/145 X |

FOREIGN PATENT DOCUMENTS

| | | | |
|---|---|---|---|
| 1185092 | 1/1965 | Fed. Rep. of Germany . | |
| 851492 | 1/1940 | France | 89/145 |

*Primary Examiner*—David H. Brown
*Assistant Examiner*—John E. Griffiths
*Attorney, Agent, or Firm*—Michael L. Dunn; William H. Holt

[57] ABSTRACT

An automatic pistol is disclosed which is recoil-operated and has mechanical locking means. The locking action between the barrel casing and the breech member is effected by means of an amply dimensioned locking member pivotally supported within the breech member and participates in the movement thereof. Coupling means provided between the trigger lever and the striking lever are formed by crank-like means and are adapted to be controlled by corresponding control portions respectively provided on the trigger lever and the breech member or stock so that the striking lever will always move along the same distance whether the striking lever is manually cocked, cocked by the breech member, or cocked and released by pulling on the trigger. The disclosed pistol includes safety means and the pistol and safety means are operable easily and quickly with equal ease by both left-handers and right-handers.

3 Claims, 16 Drawing Figures

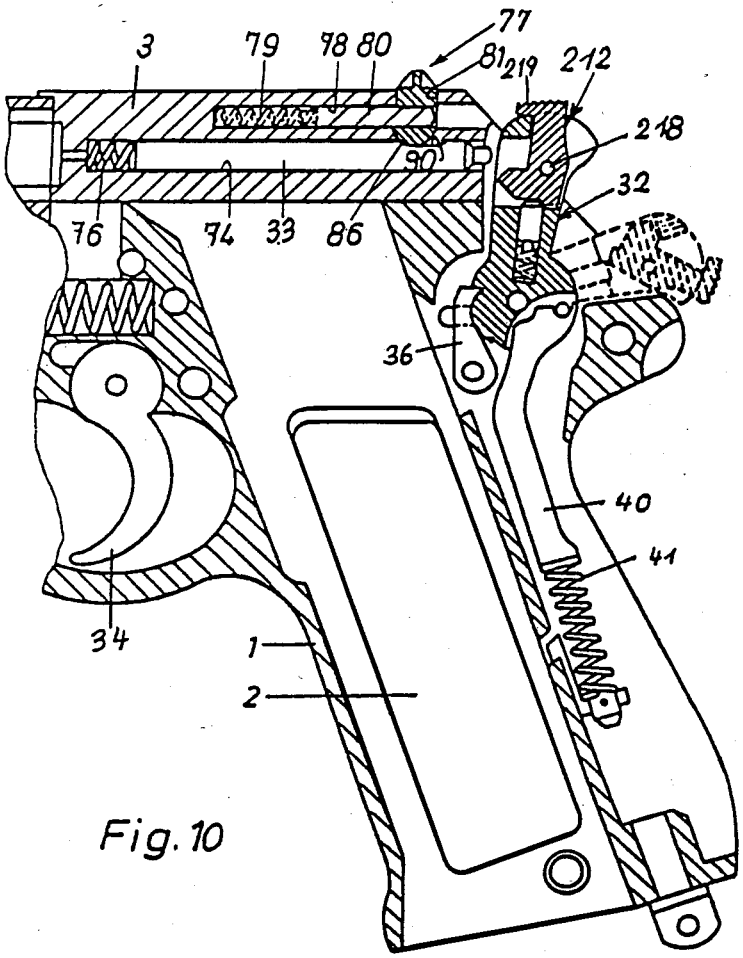
Fig. 10
Fig. 11b
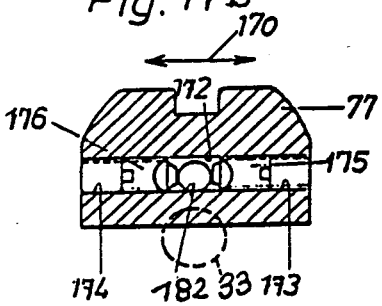
Fig. 11a
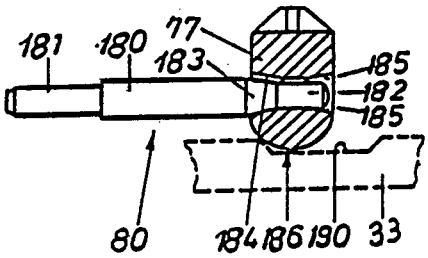

Fig.12
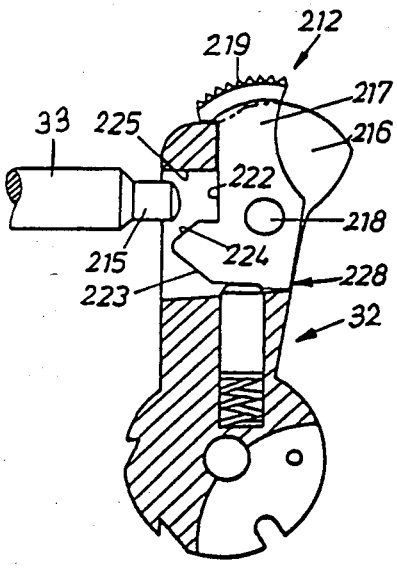
Fig.13
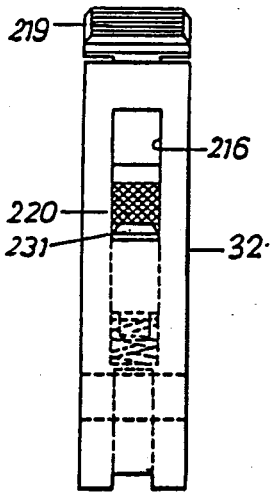
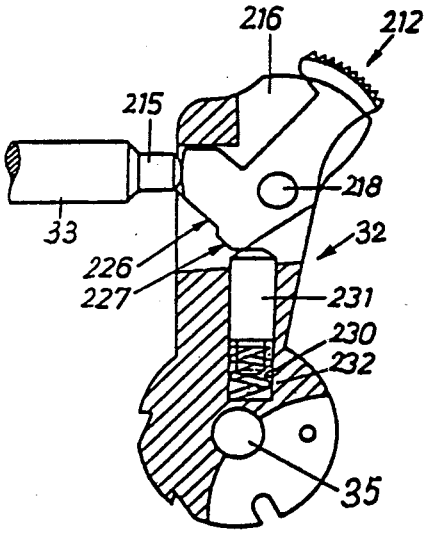
Fig.14
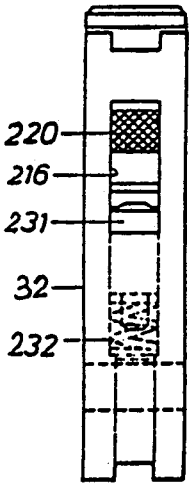
Fig.15

SELF-LOADING PISTOL IN THE FORM OF A MECHANICALLY LOCKED RECOIL LOADER

TECHNICAL FIELD OF THE INVENTION

The invention relates to a self-loading pistol in the form of a mechanically locked recoil loader, consisting of a barrel, a barrel casing, a stock housing a magazine, sliding in the barrel casing a breech member with striking pin and sighting device, a striking lever with trigger and trigger arm, a safety device, and a locking member movably mounted under the barrel.

BRIEF DESCRIPTION OF THE PRIOR ART

In self-loading pistols of this kind, the locking member movably mounted under the barrel serves to connect the barrel casing rigidly with the breech member for a limited joint rearward sliding movement, the locking member being controllable into the release position by control surfaces on the stock, while the breech member, sliding back alone, tensions at least one return spring, ejects the empty cartridge case, cocks the striking lever and, during the closing motion, re-loads from the magazine. A self-loading pistol constructed according to this principle is the firarm known under the name of Walther pistol.

In such a self-loading pistol, the striking lever can be moved by hand, by the trigger, and by the recoil movement of the breech member, into the cocked position under the tension of the striking spring acting via a striking rod and be held in this position by a spring-loaded trigger pawl. The trigger is coupled with the striking lever via a trigger arm, and the striking lever can be disengaged by cams as a function of the relative motion between the trigger arm, breech member and stock, respectively. Shooting is possible with the striking lever precocked or alternatively with the striking lever being automatically cocked by the cocking trigger with each shot. It follows that the striking path of the striking lever after a shot is fired differs in length; in particular, when shooting with the striking lever precocked, it is longer than when shooting with the trigger. In view of this different length of the paths, the striking spring must be made strong enough to accelerate the striking lever sufficiently also if the striking path is relatively short.

In such self-loading pistols the safety devices are extremely complicated and not always easy to operate. In the case of all these safety devices, the actuating member, accessible from the outside, is arranged movable on the side of the firearm, usually as a pivotable safety lever. Such a safety device is to be operated with one hand either for right-handers only or for left-handers only. It is another disadvantage of the known safety device that, when drawing the weapon, it cannot readily be seen at a glance whether the weapon is secured.

In such self-loading pistols, the sighting device is designed differently depending on whether utility hand firearms or sports weapons are involved.

The sighting edge is to be adjustable at least sideways. But also a height adjustment of the sighting edge is often desirable. The known sighting devices are extremely complicated and cause the sighting edge to stand out far beyond the breech member, thereby making it difficult to handle the weapon, and if the sighting edge is changed frequently, they easily lead to damage.

OBJECTS OF THE INVENTION

It is an object of the invention to provide a self-loading pistol of the kind more specifically defined above in which the disadvantages pointed out are avoided.

In particular it is an object of the invention to provide a self-loading pistol which is of an extremely sturdy and simple design and greatly improves the reliability and life of its parts also when used under rough conditions.

It is further an object of the invention to develop the self-loading pistol so that the cocking trigger moves very smoothly and that in a simple construction only a relatively weak striking spring is needed without the possibility of misfire occurring.

It is further an object of the invention to design the self-loading piston so that the safety device of the pistol can be operated easily and quickly by left-handers as well as by right-handers, and that, when drawing the weapon, the state of the weapon is recognizable at a glance. Lastly a self-loading pistol is to be provided which also with respect to the sighting device permits a simple and sturdy design and easy adjustability without wear having to be feared or the handling of the weapon being impaired.

SUMMARY OF THE INVENTION

These objectives are achieved in that, firstly, the locking member is mounted in the breech member and engages, in the locked position, in a locking recess in the barrel casing and is tensioned into the release position by the return spring. This locking member may be given very large dimensions; it is therefore very sturdy and its life is long. It participates in the entire movement of the breech member and may, therefore, apply directly against the spring pin of the return or closing spring and can serve directly to tension the latter during the rearward sliding movement of the breech member. In the closing position, the locking member can engage in a recess of correspondingly large dimensions on the underside of the barrel casing. The large dimensions and the manner how the locking member is mounted ensure little wear, little susceptibility to trouble, and a long life and high reliability.

The trigger arm may be operatively connected with the striking lever through a crank type coupling, which is controllable by two control sections at the trigger arm and a cam plate at both the breech member and at the stock respectively, cooperating therewith. The arrangement is such that when shooting with precocked striking lever and when shooting with the cocking trigger, the paths traveled by the striking lever are of equal length. The paths being the same, the striking spring may be made relatively weak. The soft striking spring makes for an especially smooth movement of the lock. The crank type coupling results in a very simple construction, and this, too, contributes to a smooth actuation. The simple construction increases the ruggedness and resistance to wear.

A substantial simplification of the self-loading pistol is further achieved by the fact that the safety member is disposed on the striking lever itself. Thus the safety member can be provided in the region of the longitudinal median plane of the weapon and can be equally accessible for left-handers and for right-handers; since when drawing the weapon the striking lever and hence the safety member come directly into the field of vision of the rifleman, he can ascertain the state of the weapon at a glance.

If the self-loading piston has on the breech member a movable sighting flap with adjusting device, the arrangement is expediently such that a stepped eccentric with polygonal contour, which is tensioned into contact on the breech member by a spring, is mounted on the sighting flap for rotation about a transverse axis. If the sighting device is designed so that on the top side of the breech member a transversely extending notch receiving the sighting edge is provided, the sighting is expediently insertable in the notch from above and is secured by a wedge body guided parallel to the striking pin below the breech member, said wedge body protruding into a window in the sighting edge and being tensioned in locking direction by a spring.

Both forms of realization permit a simple design, easy changing or adjusting, and a trouble-free arrangement of the sighting device.

BRIEF DESCRIPTION OF THE DRAWINGS

In the following, the invention will be explained more specifically in several embodiments with reference to schematic representations, showing:

FIG. 10, in a fragmentary vertical sectional view, the rear part of the self-loading pistol to illustrate the safety device and a form of realization of the sighting edge;

FIGS. 11*a* and 11*b*, the sighting device according to FIG. 10 in sectional view, namely in longitudinal and transverse section, respectively;

FIGS. 12 and 13, on a larger scale, in side view and section and respectively in a rear view, the striking lever of FIG. 10 in the secured state; and FIGS. 14 and 15, in a view similar to FIGS. 12 and 13, the striking lever with the safety catch released.

DETAILED DESCRIPTION OF THE INVENTION

Figure 1:
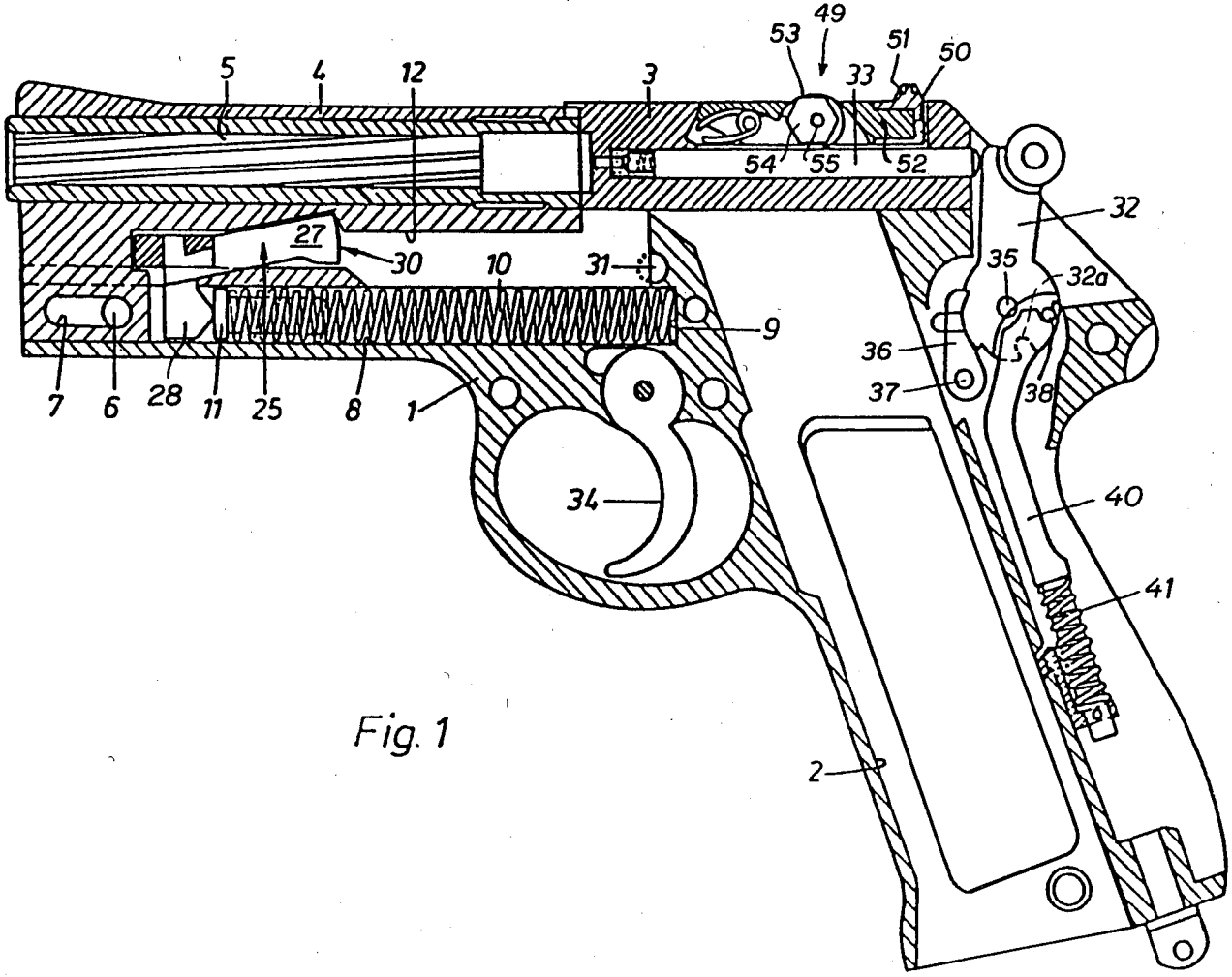
FIG. 1, the new self-loading pistol in side view, namely in a vertical sectional view.

In the description which follows, like parts are designated by the same reference symbols. The magazine is not shown in the figures.

The self-loading pistol comprises a stock 1 of metal with a magazine shaft 2. A breech member 3, in which the striking pin 33 is guided in a lengthwise displaceable and yielding manner, is provided on stock 1 to be guided lengthwise. The striking lever 32 is mounted on the stock for pivotal movement about the striking lever pin 35. In addition, there is guided for lengthwise sliding on the stock a barrel casing 4 receiving the tubular barrel 5. The displacement path of the barrel casing 4 is limited by joint action of a cross-pin (6) with an elongated slot 7. On the underside of barrel casing 4, a longitudinal recess 12 is provided, which is limited rearwardly by an upwardly extending abutment section of the stock, in which a recess 31 is provided to receive a damping cushion. At the front end of the stock 1 a cross-rib 20 is provided, which can move in the longitudinal recess 12 extending over approximately the full length of the barrel casing 4. The forward position of rib 20 can be seen from FIG. 1, the rearward position from FIG. 2. In the cross-rib 20 a bearing recess 21 for an upwardly protruding shoulder 26 of a locking member 25 is provided which, being an angle lever, is formed with two arms. Its longer locking arm 27 extends from the shoulder 26 rearwardly and is received, in the unlocked state according to FIG. 2, in the longitudinal recess 12. The shorter arm 28 projects downwardly from shoulder 26 as a control arm into a lengthwise guideway 8, which is arranged parallel to the longitudinal recess 12 in the stock, has approximately the same length as the longitudinal recess, and receives one or more return or closing spring 10. The end of the spring lies in a rearward bore 9 of the stock. A spring pin 11 at the front end of the spring 10 applies against a rearwardly pointing nose of the control arm 28. In the example shown, only return spring 10 is provided, which engages at the control arm 28 disposed centrally at the locking member 25. As compared with the control arm, the locking arm 27 may have a greater width extending beyond the lengthwise guideway 8. The locking arm 27 may have downwardly extending control projections (not shown) which cooperate with corresponding rigid control surfaces 15, 16 of the stock.

The barrel casing 4 has on the underside a locking recess 13, designed for receiving the locking arm 27 in the locking position. In the unlocked position according to FIG. 2, the locking arm 27 comes to apply against the damping cushion inserted in recess 31, to limit the movement of breech member 3. During the recoil movement, the control arm 28 tensions spring 10. The latter can subsequently guide the breech member 3 into the closing position according to FIG. 1 while taking along a cartridge from the magazine. In this movement the downwardly pointing control nose at the free end of the locking arm 27 strikes against the rigid bevel surface 16, so that locking arm 27 is pivoted into the locking recess 13 and is maintained therein by the rigid control surface 15. In the opposite movement of the breech member 3 after a shot has been fired, the barrel casing 4 is entrained until locking member 25 disengages from the rigid control surfaces 15, 16, so that the breech member 3 continues its further path without entraining the barrel casing 4.

Through the swivel movement of the locking member due to the controlling action of control surface 16, spring 10 is given an additional tension, which remains stored in the spring and ensures that after a distance traveled of only 8 to 10 mm the locking member is pivoted into the position releasing the barrel casing 4.

The dimensions of locking member 25 and locking recess 13 are large, resulting in a sturdy design sure to close. The movement of locking member 25 is controlled solely by the closing spring 10 in conjunction with fixed control surfaces 15, 16. The control surfaces are large and hence not susceptible to wear and yet the movements of the large locking member are relatively short. The rugged simple construction makes the self-loading pistol especially suitable for use under rough conditions.

At the top of breech member 3, a deep longitudinal recess 50 is provided above the striking pin 33. Into this longitudinal recess the sighting device 49 is insertable as a unit. According to FIGS. 1 and 2, the sighting device consists of a sighting flap 56, which is pivotable about an axis of rotation 57. Before insertion of swivel pin 57, the sighting flap 56 can be slipped with its front end into an undercut region at the front end of recess 50. With respect to swivel pin 57 the sighting flap 56 is two-armed. At the forward arm there engages a tensioning spring 58 wound around pin 57, so that the sighting flap 56 is tensioned clockwise in FIG. 2. For adjustment in height the sighting flap 56 has a window and therein a polygonal stepped eccentric 54 freely rotatable about the transverse axis 55. On the axle thereof a knurled wheel 53 is non-rotationally provided behind the plane of the drawing, by means of which (wheel) the stepped eccentric can be rotated counter to the tension of spring 58 thereby the level of the sighting flap 56 can be changed. Easy-to-read marks can indicate the height adjustment of the sighting flap 56 in an easily visible manner.

At the free rearward end of the sighting flap, the sighting edge 51 is guided at lever arm 52 for displacement in transverse direction, and by means of lateral cross-screws not shown it is adjustable and not fixable.

The figures illustrate that the sighting flap 56 with the appertaining parts is received in breech member 3 completely recessed, and only the upper part of the sighting edge 51 protrudes upwardly by 2 to 3 mm.

For changing the possible adjustments, the stepped eccentric 54 can easily be replaced after the sighting flap 56 has been flapped up.

Figure 2:
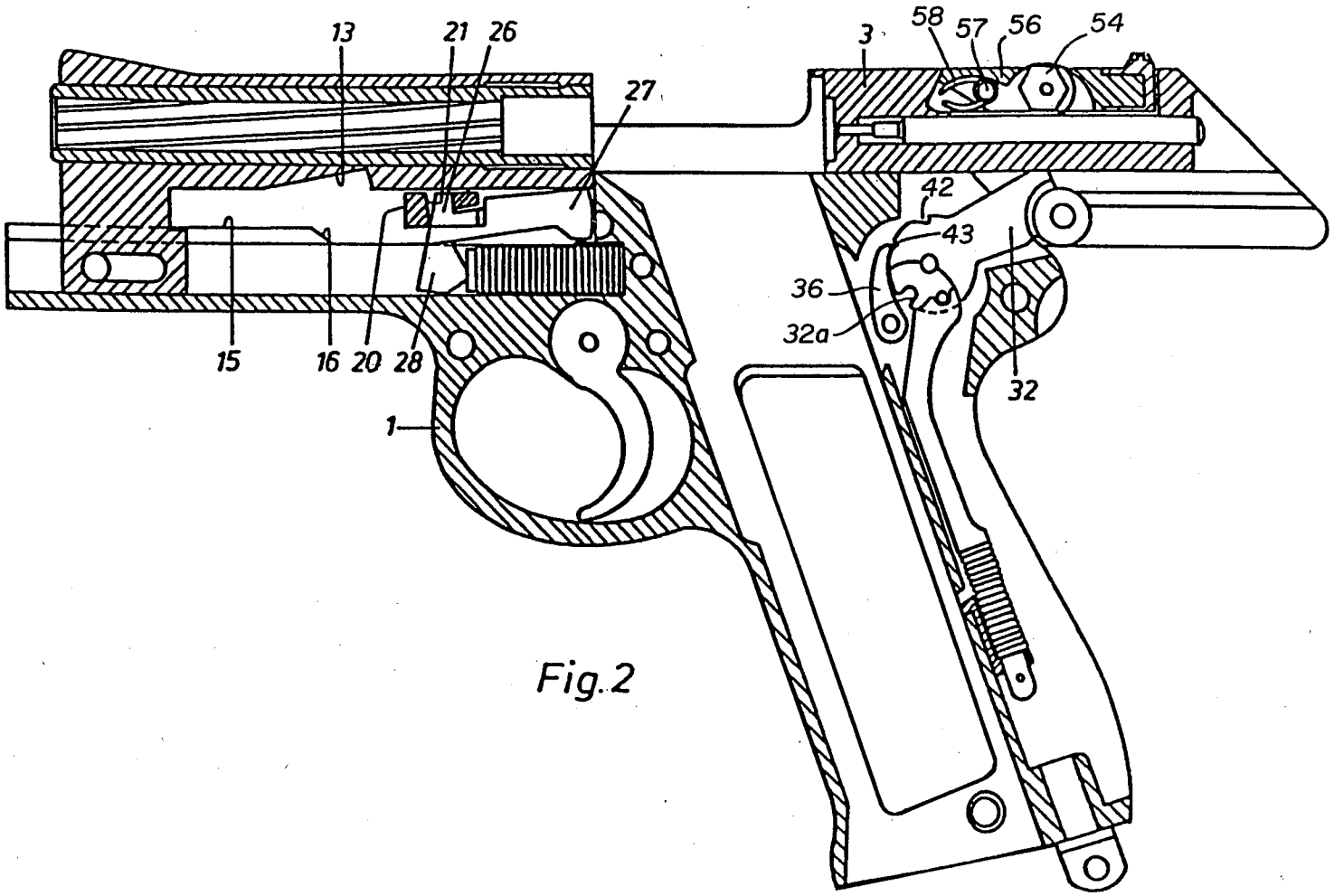
FIG. 2, the self-loading pistol according to FIG. 1 in the same view, in the open state.
Figure 3:
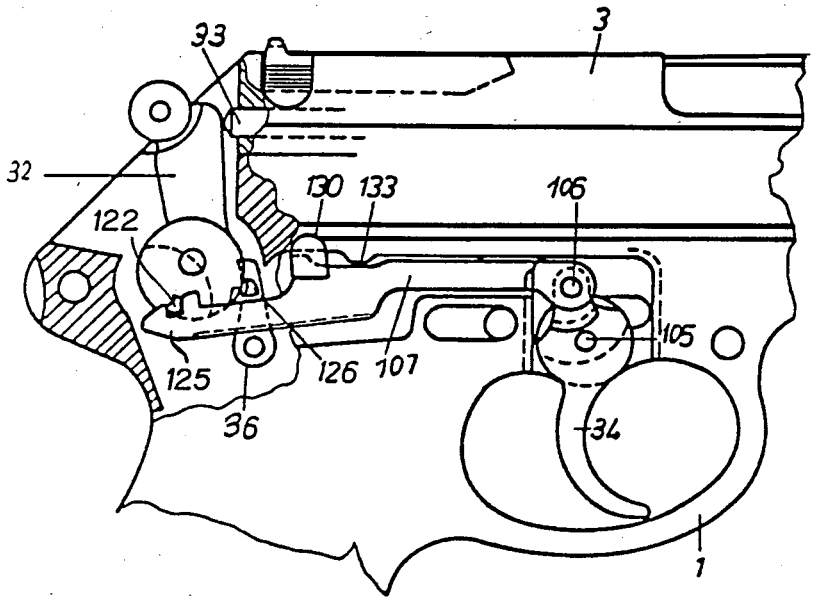
FIG. 3, as a fragmentary side view, parts of the trigger device.
Figure 4:
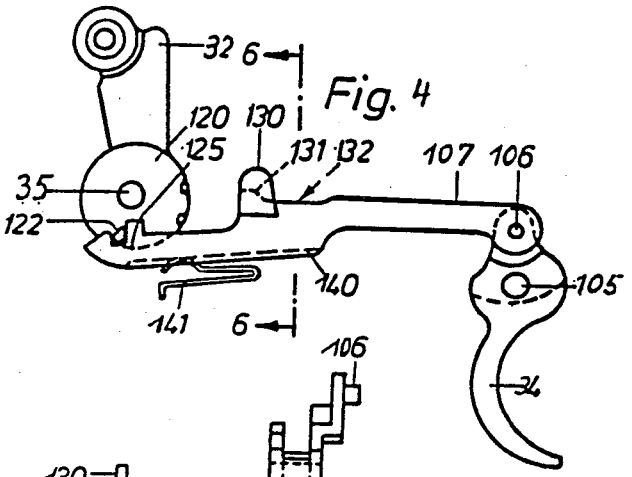
FIG. 4, parts of the trigger device according to FIG. 3, separated from the pistol.

Centrally on stock 1 the striking lever 32 is mounted for pivotal movement about the transversely extending striking lever pin 35. A trigger pawl 36 under spring tension pivotally mounted at 37 cooperates with corresponding detent notches 42 and 43 of striking lever 32. At an eccentric pin 38 of striking lever 32 there engages the upper end of a striking rod 40 which is guided in stock 1 and is under the action of a striking spring 41. In FIGS. 1, 3 and 4, the striking lever 32 is shown in the inoperative state, in FIGS. 2, 8 and 9, in the cocked state.

Figure 5:
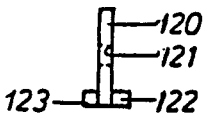

On the striking lever pin 35 a driver disk 120 is mounted for free rotation by means of a central bearing bore 121 (cf. FIG. 5). On its opposite sides the driver disk 120 has crank type pins 122, 123, which are preferably in mutual alignment. Driver pin 123 engages in a corresponding peripheral recess **32*a* in the striking lever 32, so that the driver disk 120 and striking lever 32 are coupled together. Pin 122 engages in a recess at the end of the trigger sear 125 of a trigger arm 107**.

On its underside, the trigger arm 107 has a longitudinal groove 140, in which there engages one leg of a tensioning spring 141, whose other leg is anchored in stock 1. Spring 141 tensions the trigger sear 125 toward engagement with pin 122.

The forward pointing end of trigger arm 107 is articulated at 106 on the two-armed trigger lever 34 pivotally mounted at 105. Between sear 125, which through a driver acts on the lateral shoulder 126 of trigger pawl 36, and the point of articulation 106, trigger arm 107 has an upwardly projecting interruptor cam 130 which, according to FIG. 9, cooperates with cam plates 144, 145 on the underside of breech 3, in such a way that upon recoil of breech 3 the interruptor cam 130 is pushed down far enough for sear 125 to disengage from pin 122 and from shoulder 126, so that the trigger pawl 36 fixes the striking lever 32 until the trigger lever 34 is actuated again.

Figure 7:
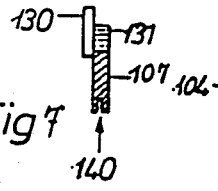
FIGS. 5 to 7, details of the trigger device.
Figure 6:
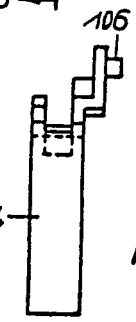

FIG. 7 shows that the interruptor cam 130 is disposed on one side of the trigger arm 107. In the plane thereof, an additional cam type control section 131, which cooperates with a cam plate 133 on stock 1, is located next to the interruptor cam. The oppositely extending control sections 131 and 133 interact to disengage the coupling between trigger sear 125 and driver disk 120. In the inoperative position of the striking lever 32 as shown in FIG. 3 the sections 131 and 133 are inactive, as they lie in corresponding recesses 132 of trigger arm 107 or respectively at stock 1.

Figure 8:
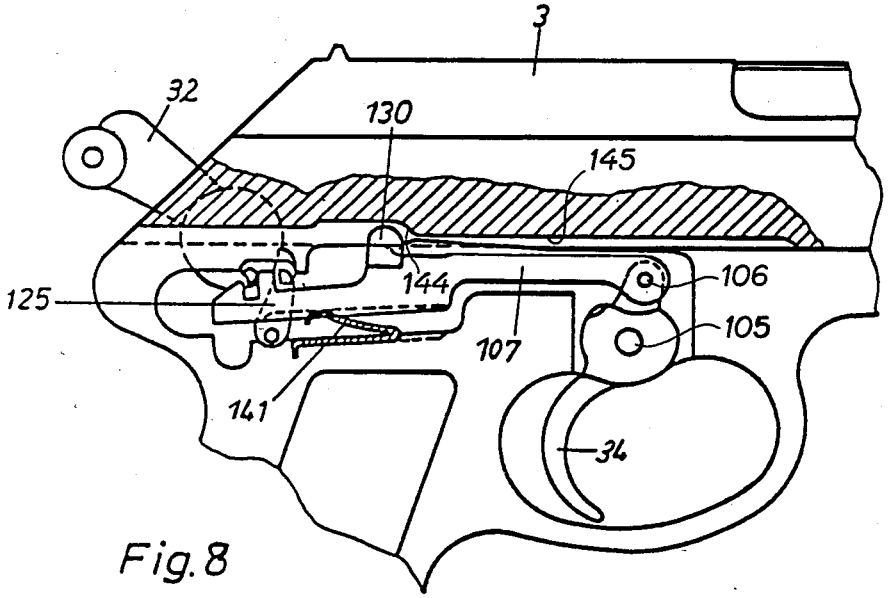
FIGS. 8 and 9, in a view similar to FIG. 3, the trigger in different positions.
Figure 9:
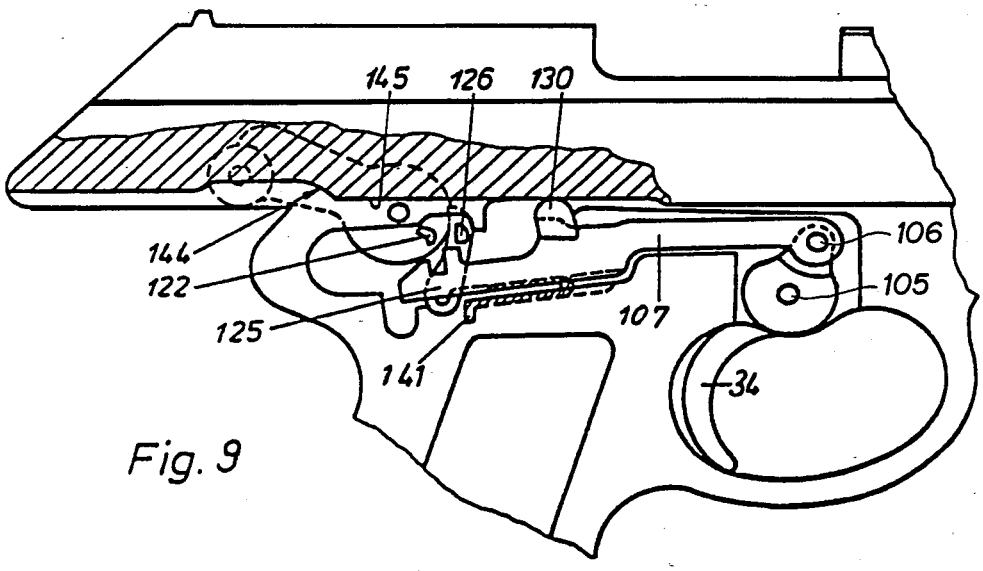

The striking lever 32 can be brought from the position according to FIG. 3 into the position according to FIG. 8 through the trigger lever 34. Upon further pulling back of trigger lever 34, the driver at trigger arm 107 releases the trigger pawl 36, so that the shot is fired by release of the striking lever. By the oppositely moving control cams 131 and 133 provision is made that also for actuation with the cocking trigger the striking lever 32 is first brought into the same initial position according to FIG. 8 as when cocking the striking lever 32 by hand, before the shot can be fired. It is thereby ensured that the striking lever 32 must always travel the same path from its cocked state to impingement on the striking pin 33. Therefore, the striking spring 41 always acts in the same manner and with the same force. Without danger of misfire, a relatively soft striking spring 41 can be used. The coupling between trigger arm 107 and driver disk 120 can easily be interrupted with the aid of the trigger lever 34 in such a way that reliable operation for single-shot fire is ensured. Instead of the sighting device according to FIGS. 1 or 2, an adjustable sighting edge 77 according to FIGS. 10 and 11 may be provided. For this purpose the breech 3 has a cylindrical longitudinal bore 78 parallel to and above the longitudinal bore 74 for the striking pin 33 tensioned by spring 76, and near the rear end of the longitudinal bore 78, an upwardly open notch 81 extending crosswise. Notch 81 and the underside 86 of the inserted sighting edge 77 extend into the longitudinal bore 74 of the striking pin 33, namely into a recess 190 of limited length on the top side of striking pin 33 (cf. FIG. **11*a*), which recess 190** may circle all around.

The sighting edge 77 has a window in the form of an elongated slot 172. In the lengthwise direction of sighting edge 77, threaded bores 173 and 174 for headless screws 175 and 176 are open at the end faces of this window 172 on both sides. Viewed in transverse section according to FIG. **11*a*, the limiting edges 184, 185 of window 172** are bevelled.

In the longitudinal bore 78 are slidably received a tensioning spring 79 and a cylindrical wedge body 80. At one end of its cylindrical section 180 the cylindrical wedge body has a tapered section 181 which engages in the tensioning spring 79. At the rear end the wedge body has a section 183 tapering in wedge form and a tapered cylindrical end 182, which both extend into the window 112 of the sighting edge 77. The wedge-shaped section 183 cooperates with the oblique limiting edges 184 of window 112, so that under the action of the tensioning spring 79 the wedge body 80 pushes the sighting edge 77 reliably back downward into notch 81. For inserting the sighting edge 77, the wedge body 80 and striking pin 33 are pushed back. By adjusting the headless screws 175, 176, the sighting edge 77 can be adjusted sideways relative to the wedge body 80 guided in bore 78. By screwing the headless screws tight, the position of the sighting edge 77 is secured reliably in every set position. In the inserted position the sighting edge 77 serves at the same time to secure the position of the striking pin 33 in its bore 74, without impeding the longitudinal slidability of the striking pin.

The striking pin 33 and sighting edge 77 can be exchanged equally easily and quickly.

According to FIG. 10, the striking lever 32 has a central recess 216 (cf. FIG. 12) which is open toward the front and toward the back. In this recess 216, a two-armed safety member 212 is mounted to swivel about a transverse pin 218. The safety member 212 has an actuating arm 217 extending upward and rearward, at the free end of which a grip section 219 sliding on the back of striking lever 32 is provided, which can be reached equally well for right-handers and for left-handers. Between a nose or lug at the lower lever of the safety member 212 and the actuating arm 217 a recess 222 is provided which, when the weapon is secured, is arranged in longitudinal alignment with the striking pin 33 to receive the striking pin end 215 when the striking lever 32 is in the state not cocked. In this position the safety member 212 is secured by a detent pin 231 disposed radially to the pivot pin 35, which detent pin is arranged in a bore 230 of the striking lever 32 and under the action of an outwardly directed tensioning spring 232. In the position according to FIG. 12, pin 231 applies against a shallow locking recess 226 on the underside of safety member 212.

The lug at the lower arm of the safety member 212 is limited by two bevels 223, 224. When the safety member is pivoted out of the position per FIG. 12 into the position per FIG. 14, bevel 224 places itself against an abutment surface 225 of striking lever 32, whereby bevel 223 comes to lie perpendicular to the sliding direction of striking pin 33 and in alignment with the end 215 thereof. Thus, in the uncocked position of striking lever 32, the tapered end 215 of striking pin 33 takes support elastically on the bevel 223 of the safety member 212. This position of the safety member is secured by the same locking pin 231 whose end engages the rearward surface 228 behind a shoulder 227 limiting recess 226. In this manner assurance is given that in the position per FIG. 14, when a shot is fired, the striking force of striking lever 32 can reliably be transmitted to the safety member 212 and thence to the striking pin 33 for firing of the shot.

The portion of the safety member 212 protruding backwardly out of recess 216 may have a conspicuous mark 220 (FIG. 13, FIG. 15) which is easily visible from behind and readily indicates the state of the safety device and hence the state of the firearm.

The described safety device may be the sole safety device of the weapon. The safety member 212 can easily be exchanged if damaged. Large-area contacts provide for reliable transmission of the occurring forces. The design not only facilitates actuation of the safety device. Rather it becomes possible also through the actuating lever 217, 219 of the safety member 212 to pivot the striking lever 32 back into the cocked position by hand at the same time, so that releasing the safety catch and cocking of the weapon are a single operation.

We claim:

1. A self-loading pistol including a breech member (3), means for slidably mounting said breech member; a striking pin (33) and means for slidably mounting said striking pin within said breech member; a striking lever (32) and means for pivotally mounting said striking lever for rotation between a cocked position and a position for engaging said striking pin; a striking rod (40) engaged with said striking lever, and a striking spring (41) engaged with said striking rod for impelling said striking lever from said cocked position into engagement with said striking pin; means on said striking lever for facilitating manual movement of said striking lever from a position adjacent to said striking pin to said cocked position; a trigger (34), a trigger arm (107) connected between said trigger and said striking lever, and means for moving said striking lever to said cocked position upon movement of said trigger toward said striking lever; said striking lever being disposed in alignment with said breech member for moving said striking lever into said cocked position during sliding movement of said breech member toward said striking lever; and means for releasing said striking lever always from the same cocked position for applying equal force to the striking lever by said striking spring during each release of said striking lever.

2. A self-loading pistol as defined in claim 1 wherein said means for pivotally mounting said striking lever includes a striking lever pin (35); said means for moving said striking lever to said cocked position including a driver disk (120) rotatably mounted on said striking lever pin, a peripheral recess (**32*a*) formed in said striking lever, and a first crank pin (123) integral with said driver disk and extending into said peripheral recess for connecting said driver disk to said striking lever; a trigger sear (125) formed in said trigger arm, a second crank pin (122) integral with said driver disk, and spring means (141**) for moving said trigger sear into engagement with said second crank pin for releasably connecting said trigger arm and said trigger to said striking lever.

3. A self-loading pistol as defined in claim 2 wherein said means for releasing said striking lever includes a detent means (43) formed in said striking lever, a pawl means (36) engageable in said detent means for holding said striking lever in said cocked position, and means actuated by said trigger for removing said pawl means from said detent means.

* * * * *